US012404685B1

(12) United States Patent
Erickson et al.

(10) Patent No.: US 12,404,685 B1
(45) Date of Patent: Sep. 2, 2025

(54) SIDEWALK SHED SCAFFOLD APPARATUS, SYSTEM AND METHOD

(71) Applicant: Core Scaffold Systems, Inc., New York, NY (US)

(72) Inventors: Kevin N. Erickson, New York, NY (US); Valon Pilku, New York, NY (US)

(73) Assignee: Core Scaffold Systems, Inc., New York, NY (US)

( * ) Notice: Subject to any disclaimer, the term of this patent is extended or adjusted under 35 U.S.C. 154(b) by 0 days.

(21) Appl. No.: 19/010,792

(22) Filed: Jan. 6, 2025

Related U.S. Application Data

(60) Provisional application No. 63/557,666, filed on Feb. 26, 2024.

(51) Int. Cl.
*E04G 1/04* (2006.01)
*E04G 1/15* (2006.01)
*E04G 21/32* (2006.01)

(52) U.S. Cl.
CPC ..... *E04G 1/04* (2013.01); *E04G 1/15* (2013.01); *E04G 21/3209* (2013.01)

(58) Field of Classification Search
CPC .... E04G 1/04; E04G 1/15; E04G 1/20; E04G 1/34; E04G 7/302; E04G 7/304; E04G 21/3209; E04B 1/2403
See application file for complete search history.

(56) References Cited

U.S. PATENT DOCUMENTS 1,746,027 A 2/1930 Canon
3,593,477 A * 7/1971 Briggs ..... E04B 1/185 52/283
3,690,407 A 9/1972 Cullison
3,716,959 A * 2/1973 Bernardi ..... E04B 1/2403 52/837

(Continued)

FOREIGN PATENT DOCUMENTS

CN 112302167 2/2021
WO WO2019107696 6/2019

OTHER PUBLICATIONS

Power Point Presentation, presented Jul. 1, 2025, pp. 1-7, author Robert Yarbrough, attorney at Lipton, Weinberger & Husick IPL.*

(Continued)

*Primary Examiner* — Colleen M Chavchavadze
(74) *Attorney, Agent, or Firm* — Robert J. Yarbrough; Lipton, Weinberger & Husick

(57) ABSTRACT

A sidewalk shed and system includes a plurality of columns and a plurality of major beams. Each column includes one to four column face plate assemblies, based on the application, for attachment to major beams. Each column face plate assembly comprises a column face plate, trapezoidal-shaped top and bottom gussets, and a vertical plate support, which in combination support the column face plate in a spaced-apart relation to a column. Major beam face plates attached to the opposing ends of a major beam releasably engage the column face plate assemblies using fasteners. Minor beams (Continued)

span opposing major beams. The minor beams may support other sidewalk shed structures, such as decking, parapets, lighting, signage, and other scaffolding.

18 Claims, 13 Drawing Sheets

(56) References Cited

U.S. PATENT DOCUMENTS

| | | | | |
|---|---|---|---|---|
| 3,807,120 | A | 4/1974 | Viandon | |
| 4,054,392 | A * | 10/1977 | Oppenheim | F16B 7/18 403/189 |
| 4,925,330 | A | 5/1990 | Cornish | |
| 5,054,580 | A | 10/1991 | Cheek | |
| 5,678,375 | A * | 10/1997 | Juola | E04B 1/24 52/236.7 |
| 5,768,829 | A | 6/1998 | Thompson | |
| 6,557,666 | B1 | 5/2003 | Drouin | |
| 6,837,016 | B2 | 1/2005 | Simmons | |
| 7,637,076 | B2 * | 12/2009 | Vaughn | E04C 3/32 403/217 |
| 9,249,593 | B2 * | 2/2016 | Perko | E04B 1/2403 |
| 9,951,510 | B2 * | 4/2018 | Lee | E04B 1/388 |
| 10,000,919 | B2 * | 6/2018 | Oba | E04B 1/2403 |
| 10,179,991 | B2 * | 1/2019 | Houghton | E04H 9/021 |
| 10,253,492 | B2 * | 4/2019 | Uno | E04B 1/5812 |
| 10,626,595 | B2 | 4/2020 | Ramezani | |
| 10,633,851 | B2 * | 4/2020 | Mou | E04H 9/024 |
| 10,907,367 | B2 * | 2/2021 | Dixon | E04G 1/18 |
| 10,975,584 | B2 * | 4/2021 | Brownmiller | E04G 7/02 |
| 11,098,476 | B2 * | 8/2021 | Jin | E04B 1/2403 |
| 11,299,880 | B2 * | 4/2022 | Pryor | E04B 1/24 |
| 2003/0041549 | A1 * | 3/2003 | Simmons | E04B 1/2403 52/655.1 |
| 2011/0204307 | A1 | 8/2011 | Bowman | |
| 2012/0255256 | A1 | 10/2012 | Montalto | |
| 2017/0114555 | A1 | 4/2017 | Henneberry | |
| 2017/0159304 | A1 | 6/2017 | Young | |
| 2022/0170278 | A1 | 6/2022 | Barnard | |
| 2022/0282500 | A1 | 9/2022 | Evans | |
| 2023/0323680 | A1 | 10/2023 | Libani | |

OTHER PUBLICATIONS

Color photographs of prior art sidewalk sheds, New York, New York, Jan. 2024, attached.

* cited by examiner

SIDEWALK SHED SCAFFOLD APPARATUS, SYSTEM AND METHOD

FIELD OF THE INVENTION

The Invention relates to sidewalk sheds for the protection of pedestrians walking on sidewalks adjacent to buildings, as during construction, renovation, maintenance or demolition of a building. The sidewalk shed system of the Invention provides robust structural strength combined with relatively light weight. The sidewalk shed system also avoids the visual clutter and limitations on pedestrian movement of diagonal cross bracing.

STATEMENT OF THE RELATED ART

A 'sidewalk shed' is a combination of a temporary scaffold and a roof supported by the scaffold. Sidewalk sheds are commonly used to cover sidewalks adjacent to buildings in a city during operations on or of the building. The purpose of the sidewalk shed is to prevent objects falling from the building, such as tools, debris, or building materials, from reaching the sidewalk or the adjacent street. The sidewalk shed also may support conventional scaffolding on top of the sidewalk shed.

Sidewalk sheds generally must meet both legal and practical requirements. For example, sidewalk sheds are required in New York City for construction of any building over 40 feet high or demolition of any building over 25 feet high, and most must be capable of supporting 300 pounds per square foot. On the practical side, the building and street front may include businesses or residences. The sidewalk shed must not interfere with ingress or egress, and should preserve the appearance of the streetscape and of the affected businesses as much as is possible.

Most prior art sidewalk sheds utilize diagonal cross bracing to ensure that the elements of the sidewalk shed are square and to prevent collapse of the sidewalk shed. The diagonal cross bracing provides visual clutter and may block movement of pedestrians and customers between the columns used to support the sidewalk shed.

The prior art does not teach the sidewalk shed system of the invention.

BRIEF DESCRIPTION OF THE INVENTION

The sidewalk shed system of the Invention includes vertical columns and horizontal major and minor beams. The vertical columns and horizontal major beams releasably attach one to another by fasteners penetrating column face plates and corresponding major beam face plates. When joined, the columns and major beams define a rectangular grid and support minor beams and decking.

The column face plates are planar and robust. Each column has one, two, three or four column face plates disposed in a spaced-apart relation to the sides of each column at the top of the column. Each column face plate has a length and a width that is greater than the width of the column to which the column face plate is attached. The column face plates are releasably attachable to corresponding major beam face plates.

The major beam face plates, disposed at the opposing ends of the major beams, having dimensions substantially the same as the column face plates. Fasteners, such as threaded nuts and bolts, penetrate corresponding holes defined by the column face plates and the major beam face plates. The holes defined by the column face plates and major beam face plates may be laterally spaced apart by an amount greater than would be possible without the column face plates, and may be greater than the width of the column. The relatively large size of the column face plates and major beam face plates, combined with the laterally spaced-apart holes and fasteners, support torsional loads on the column-to-major beam junction to resist collapse of the sidewalk shed, all without diagonal cross-bracing.

The attachment together of corresponding column face plates and major beam face plates creates a rectangular grid of major beams fixed in their relative positions substantially on a horizontal plane, with the columns fixed orthogonal to the horizontal plane. The rectangular grid of major beams supports minor beams oriented normal to the longitudinal axis of the sidewalk and extending between adjacent major beams. The minor beams support decking on top of the sidewalk shed. The combination of major beams, minor beams, and decking results in the roof of the sidewalk shed being relatively thin compared to that of a conventional sidewalk shed.

The number of face plates attached to a column may be determined by the application of the column in the sidewalk shed. For a column located at the outside corner of the sidewalk shed, the column will have at least two face plates oriented at 90 degrees to each other. For a column located along the length of the sidewalk shed, the column will have at least three face plates, with two face plates that are parallel on opposite sides of the column and one face plate that is normal to the other two face plates. For a column located at an inside corner of the sidewalk shed; for example, where the sidewalk shed turns a corner of the sidewalk, the column will have four face plates. A column may be equipped with a single face plate where the column is attached to a building.

The columns are composed of a robust material, such as steel, and have a column length that is large compared to the column width. The columns may define a hollow structural section (HSS) and may be of any suitable cross-sectional shape, for example and without limitation circular, square or rectangular. A square column cross section has proved suitable in practice. Each column has a column base, a column top and column longitudinal axis between the column base and the column top. Each column has a column outer surface that defines a column width proximal to the column top.

Each column face plate preferably is planar and composed of a robust material, such as steel, although the column face plate may be of another shape, such as curved or of a saddle shape. The column face plate has a column face plate top end and a column face plate bottom end. Each column face plate defines a column face plate longitudinal axis between the column face plate top end and the column face plate bottom end. The column face plate longitudinal axis may be parallel to the column longitudinal axis and in a spaced-apart relation to the column outer surface, so that the column face plate is vertically oriented and parallel to the column longitudinal axis. Alternatively, the column face plate longitudinal axis may intersect the column longitudinal axis, so that the column face plate is not parallel to the column longitudinal axis.

The column face plate has a column face plate transverse axis normal to the column face plate longitudinal axis. The column face plate transverse axis and the column longitudinal axis define 'skew lines.' As used herein, the term 'skew lines' has its ordinary meaning in geometry; namely, that the line of the column face plate transverse axis is neither parallel to the column longitudinal axis nor intersects the line of the column longitudinal axis. As used herein, the term 'line' means a mathematical line. The 'skew angle' between the column longitudinal axis and the column face plate transverse axis is substantially a right angle. As used herein, the term 'skew angle' has is ordinary meaning in geometry, meaning the angle between a hypothetical line parallel to the column face plate transverse axis that intersects the column longitudinal axis is substantially 90 degrees.

The column face plate may be supported in the spaced-apart relationship to the column longitudinal axis by a top gusset, a bottom gusset, and a vertical plate. The top gusset and the bottom gusset each may be trapezoidal in shape. The top gusset defines a top gusset wide end having a width corresponding to the column face plate width. The top gusset also defines an opposing top gusset narrow end having a width corresponding to the width of the column at the column face plate. The gusset wide end is attached to the column face plate top end, as by welding. The gusset narrow end is attached to the column surface, also as by welding. The vertical plate is disposed between the column surface and the column face plate and is normal to both the column side and the column face plate. The vertical plate is oriented along the longitudinal axis of the column and is centrally located on the face plate, the top gusset and the bottom gusset. The top gusset, the bottom gusset, the column face plate, the vertical plate and the column surface are joined together, as by welding. The assembled top gusset, the bottom gusset, the vertical plate, and the column face plate in combination define a column face plate assembly.

The vertical plate and top and bottom gussets locate the column face plate in a spaced-apart relation to the column and to each other face plate attached to the column. The spaced-apart relation of the column face plates and the column provides clearance to both sides of two adjoining face plates to access fasteners, such as bolts and nuts, on either side of each face plate to connect corresponding column face plates and major beam face plates together.

A plurality of holes, for example four holes, are disposed in a spaced-apart relation penetrating each column face plate and major beam face plate. Each of the plurality of holes of the column face plate corresponds to a hole penetrating a major beam face plate or of another column face plate so that each column may be bolted to each major beam and to each other column. The column face plates and major beam face plates are sized and the holes are located so that the bolts penetrating the holes are disposed farther apart laterally from the column longitudinal axis than would be possible without the column face plate. The relatively wide spacing of the bolts results in improved resistance to torsional loading on the column-to-major-beam joint than would otherwise be the case.

The columns may be adjustable for height, as by a column base that telescopes into the hollow column bottom. Alternatively, the column may telescope into the column base. The column and the column base may include one or more corresponding height adjusting holes in the area of the overlap of the telescoping column base and column. One or more height-fixing bolts may penetrate corresponding height adjusting holes in the column and column base to define the height of the column.

Alternatively, the column base may have a threaded engagement with the column bottom. The column base may include a threaded rod having a rod axis that is coincident with the column longitudinal axis and that engages a female thread attached to the column bottom. Relative rotation of the column base and the column causes the column base to advance or retreat with respect to the column, thereby selecting the height of the column.

The major beams are composed of a robust material, such as steel, and have a beam length that is large compared to the beam width. The major beam may be an I-beam in cross section. A major beam face plate substantially identical to the column face plate is attached to each end of each major beam, as by welding. During assembly of the sidewalk shed, the major beam face plates are bolted to the column face plates to define the rectangular grid. Certain of the major beams in the rectangular grid are oriented parallel to the sidewalk longitudinal axis and are referred to herein as 'parallel major beams.' Other of the major beams are oriented normal to the sidewalk longitudinal axis and are referred to herein as 'transverse major beams.' The major beams may be of any suitable length and elongated major beams may be selected to, for example, span driveway entrances, street furniture, subway entrances, or other obstructions. Stub major beams may attach to and be supported by a single column. The stub major beam may have a major beam face plate attached to only one end of the stub beam.

Minor beams extend laterally normal to the sidewalk longitudinal axis and span the parallel major beams. The minor beams support decking on the sidewalk shed. The parallel major beams may include a plurality of spaced-apart minor beam support brackets sized to retain minor beams on the top of and spanning the parallel major beams. The presence of the minor beam support brackets reminds an installer of the correct number, location and orientation of minor beams to support the decking.

A minor beam may have an adjustable length, as by a minor beam extender configured to telescope into an end of the hollow minor beam. The adjustable minor beam may be fixed at a selected length, as by a fastener penetrating a minor beam extender hole communicating through the minor beam and the minor beam extender. A plurality of minor beam extender holes allow the extended minor beam to be fixed at any of a plurality of selected lengths. The extendable minor beam allows an installer flexibility in conforming the sidewalk shed to the facade of the adjacent building, to the width of the sidewalk, and to obstructions such as signs or road furniture.

As an alternative to an adjustable minor beam, the installer may select a minor beam having any of a plurality of fixed lengths without adjustment.

The minor beam also includes a plurality of attachment features, such as holes, disposed along the length of the minor beam and configured to engage with a minor beam support bracket. The plurality of holes allows an installer to select the location of the minor beam normal to the sidewalk longitudinal axis and to conform the minor beam to the building facade, to the sidewalk, and to signs or other obstructions.

The sidewalk shed of the Invention may include a parapet attached to the minor beams at the ends of the minor beams adjacent to the street and opposite to the adjacent building. The parapet is a vertical wall that hides materials or debris stored on the decking from the view of passersby, that may support signage, and that prevents objects on the decking from falling to the sidewalk or roadway adjacent to the parapet. The parapet may be attached to the minor beam by an angle bracket.

The decking may comprise wooden, metal or polymer planks, sheet, plate, or lattice. The decking is adequately robust to prevent debris or other objects from falling between the major or minor beams and onto the sidewalk below. The decking also serves the purpose of distributing the load of objects located on the decking to the minor beams and hence to the major beams, and then to the columns and the sidewalk. The objects on the decking may include scaffolding, workers, tools, building materials and debris. The sidewalk shed also may support artificial lighting.

DETAILED DESCRIPTION OF AN EMBODIMENT

Figure 1:
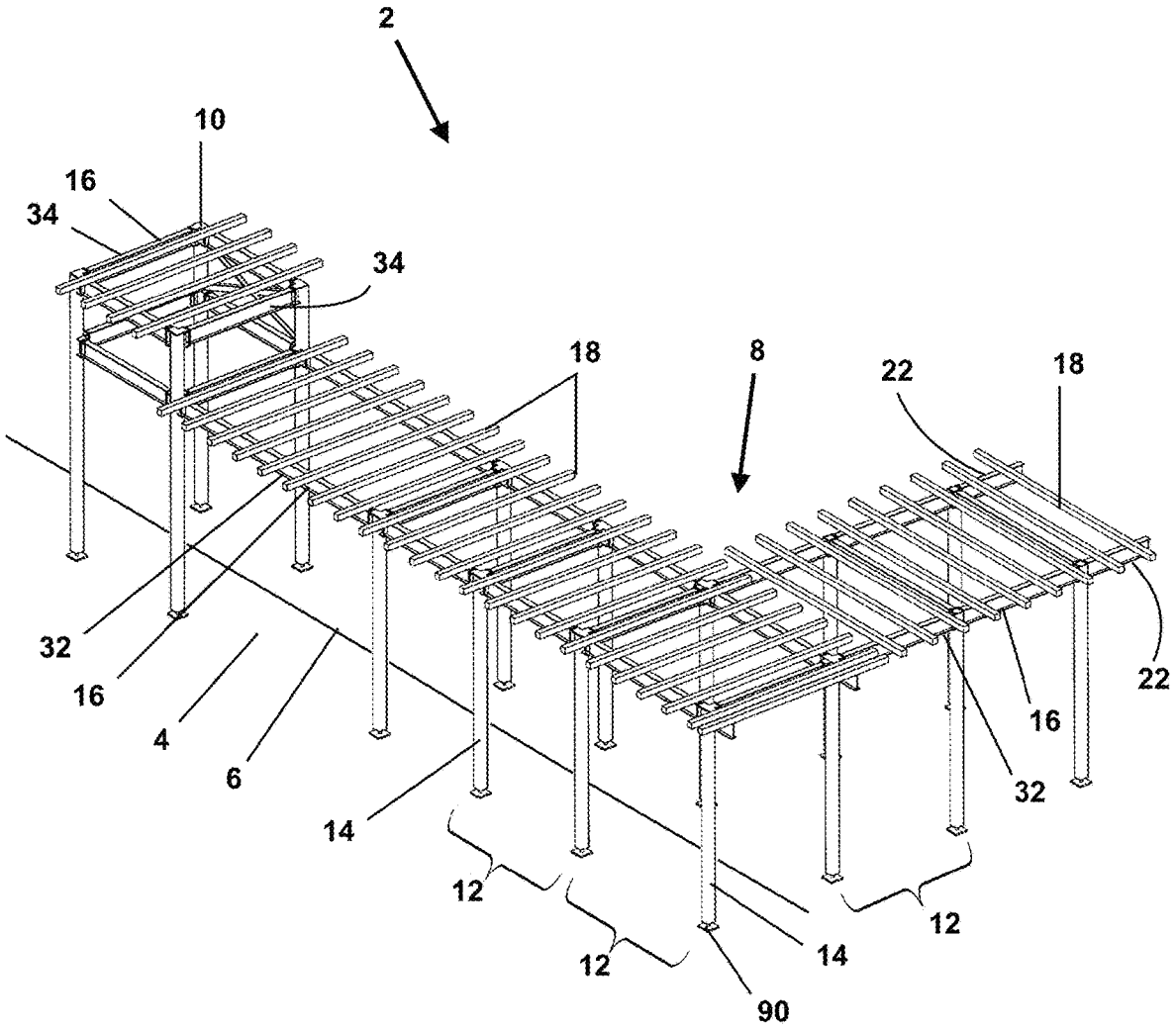
FIG. 1 is an isometric view of an example sidewalk shed of the Invention without decking or parapets.
Figure 2:
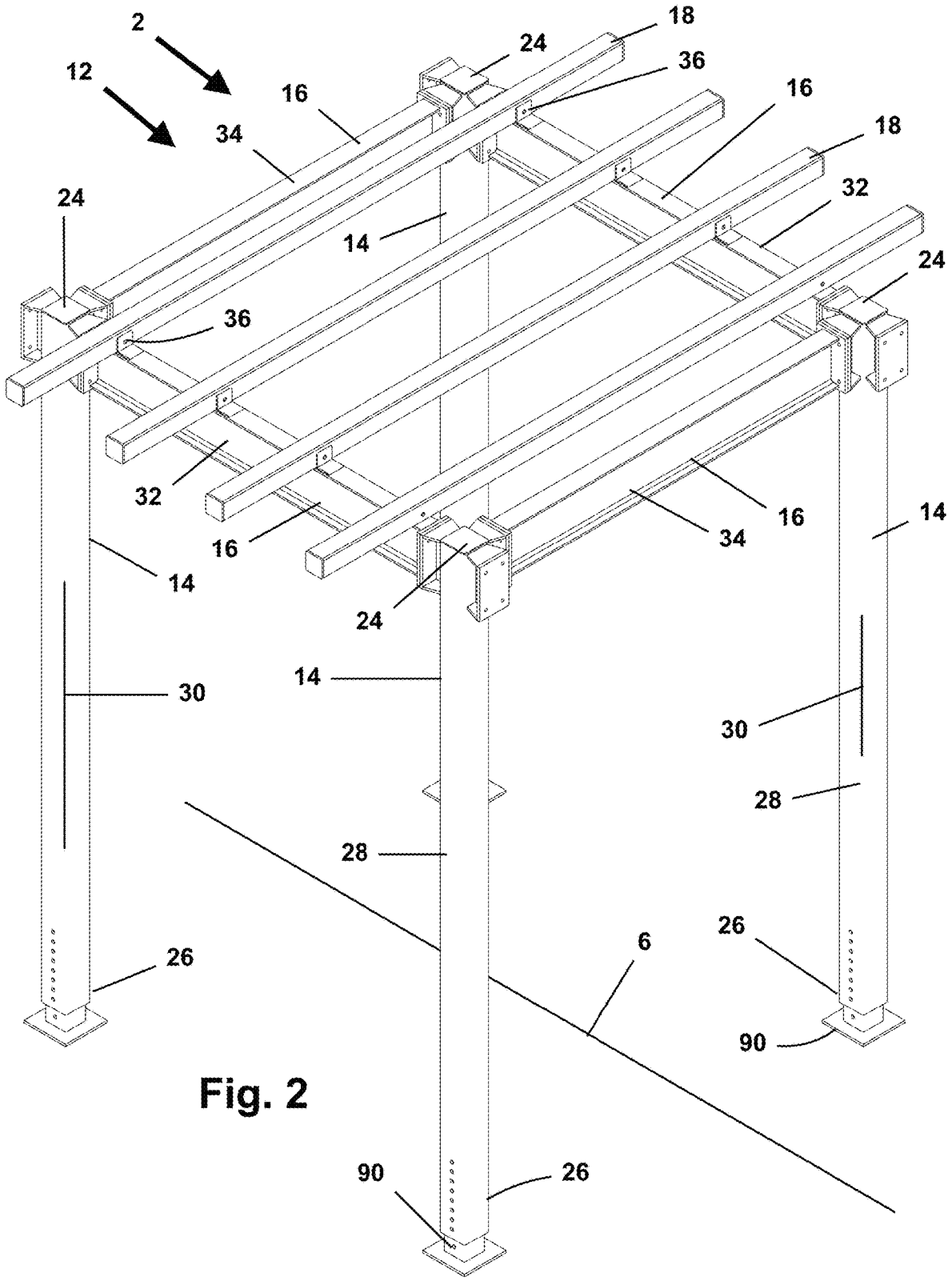
FIG. 2 is an isometric view of four major beams and four columns comprising a rectangular frame of the sidewalk shed system.

FIGS. 1 and 2 are isometric views of example sidewalk shed systems 2 of the Invention. FIG. 1 shows the sidewalk shed system 2 installed and covering a sidewalk 4. The sidewalk shed 2 of FIG. 1 extends along the sidewalk longitudinal axis 6, turns a sidewalk corner 8, and features columns 14 of different elevations 10 to accommodate, for example, a building facade. FIG. 2 shows a rectangular frame 12 comprising four columns 14 and four major beams 16, with each column 14 releasably attached to two major beams 16 and each major beam 16 releasably attached to two columns 14. The rectangular frame 12 supports a plurality of minor beams 18. The minor beams 18 support decking (not shown) and other systems such as lighting (not shown) and parapets 20 (see the discussion of FIGS. 17 and 18).

The sidewalk shed system 2 is modular and flexible and, as shown by FIG. 1, each rectangular frame 12 may be conjoined with other rectangular frames 12 by adding additional columns 14, major beams 16 and minor beams 18 to extend the sidewalk shed system 2 longitudinally or laterally or to extend the sidewalk shed system 2 around a sidewalk corner 8, all to create the rectangular grid that is the sidewalk shed. Also as shown by FIG. 1, the sidewalk shed system 2 may use pairs of major beams 16 of different lengths to conform the sidewalk shed system 2 to site conditions. From FIG. 1, the sidewalk shed system 2 may utilize stub major beams 22 that attach to only one column 14 and are cantilevered from an end of the sidewalk shed system 2.

From FIG. 2, each rectangular frame 12 includes four columns 14, each having a column top end 24, a column bottom end 26 and column sides 28. Each column 14 has a column longitudinal axis 30 that is vertically disposed when the column 14 is installed in a sidewalk shed. Each column 14 of FIG. 2 is attached to two major beams 16 that are horizontally disposed. Two of the major beams 16 of the rectangular frame 12 of FIG. 2 are parallel major beams 32 that are oriented parallel to the sidewalk longitudinal axis 6. Two of the major beams 16 are transverse major beams 34 that are disposed normal to the sidewalk longitudinal axis 6. Minor beams 18 span the parallel major beams 32. The parallel major beams 32 may include minor beam support brackets 36 to receive and retain the minor beams 18. The minor beams 18 support decking, not shown.

Figure 3:
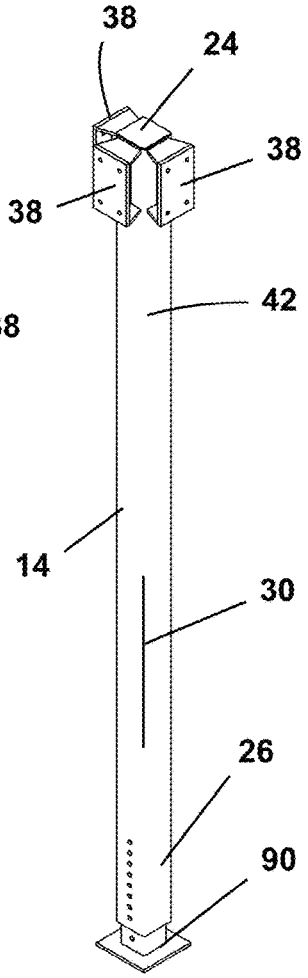
FIG. 3 is a perspective view of a column.

FIGS. 3-11 illustrate a column 14 and major beam 16 and the releasable connection between the columns 14 and major beams 16. FIG. 3 shows an example column 14 in isolation having three column face plates 38 disposed at the column top end 24. The three column face plates 38 may be bolted to corresponding major beam face plates 44, thereby attaching the major beams 16 and the columns 14 together to define the sidewalk shed system 2. Each column 14 may include between one and four column face plates 38 attached at the column top end 24, depending on the application of the column 14. As shown by FIG. 1, column face plates 38 may be attached to the column 14 at locations other than the column top 24 to allow the sidewalk shed system 2 to accommodate a building facade or other obstacles.

Figure 4:
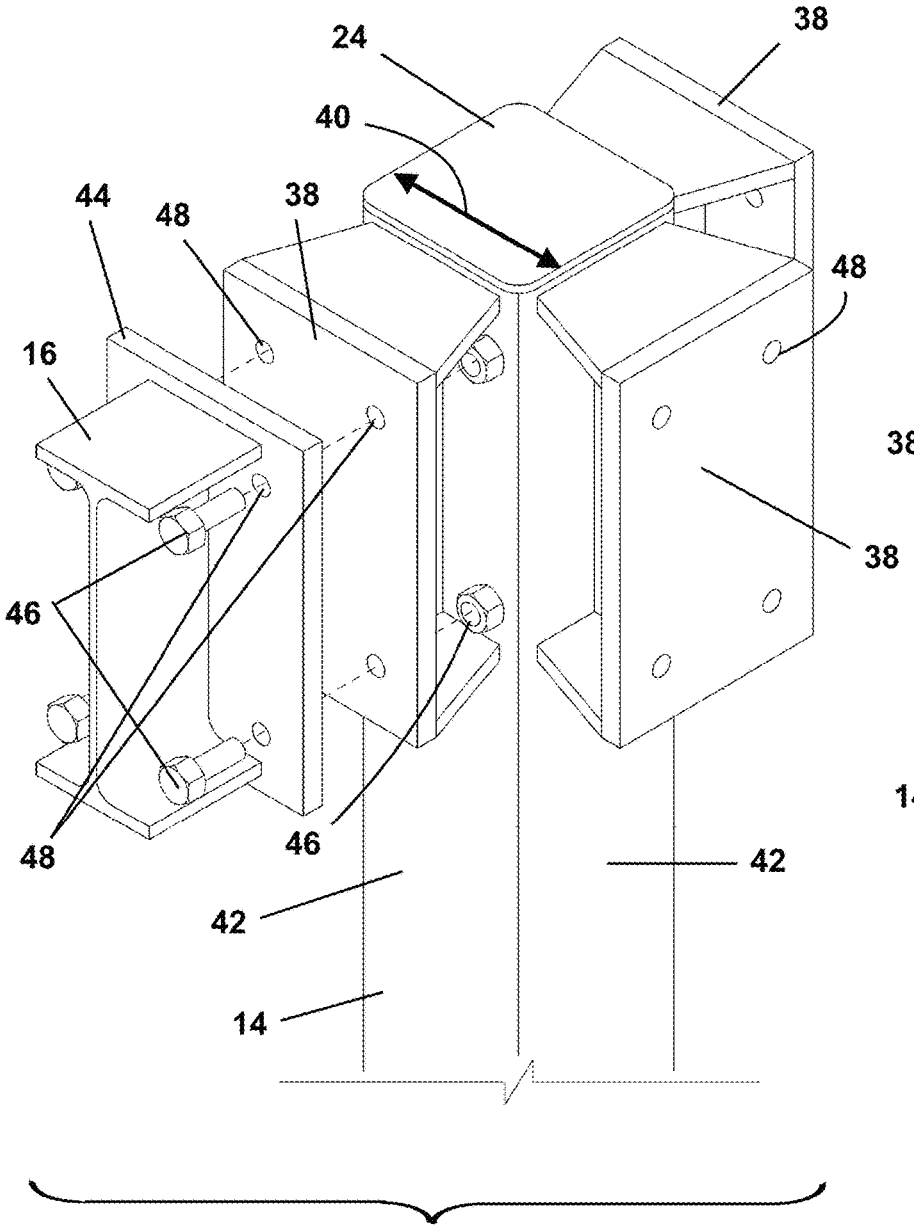
FIG. 4 is an exploded detail view of a column and major beam attachment.

FIG. 4 is a detail exploded view of the column top end 24 of FIG. 3 showing the three column face plates 38 and the attachment of one major beam 16. As shown by FIG. 4, each column 14 has a column width 40 and a column surface 42. Each column face plate 38 is in a spaced apart relation to the column surface 42 to which the column face plate 38 is attached. FIG. 4 also shows the connection of a column face plate 38 to a corresponding major beam face plate 44 by fasteners, such as bolts and nuts 46, penetrating corresponding holes 48 in the column face plate 38 and the major beam face plate 44.

Figure 5:
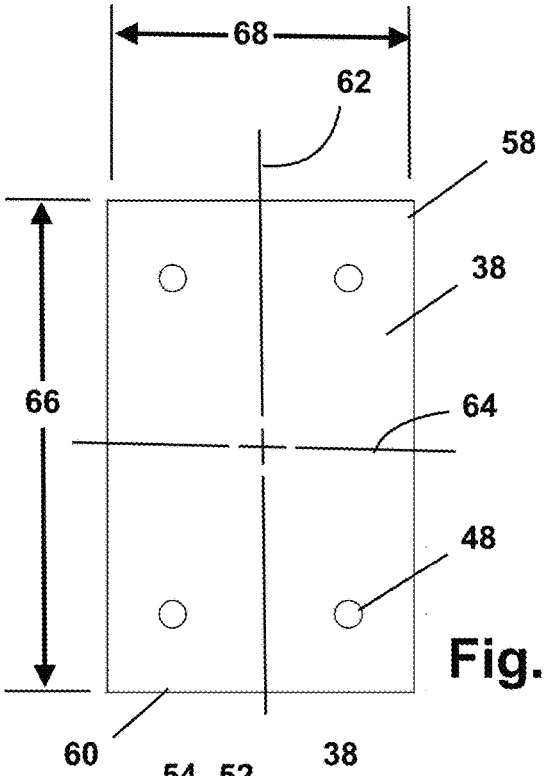
FIG. 5 is an plan view of a column face plate or a major beam face plate.
Figure 6:
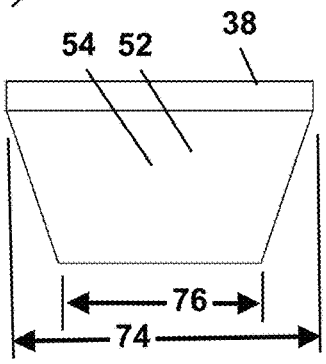
FIG. 6 is top or bottom view of a column face plate and top or bottom gusset combination.
Figure 7:
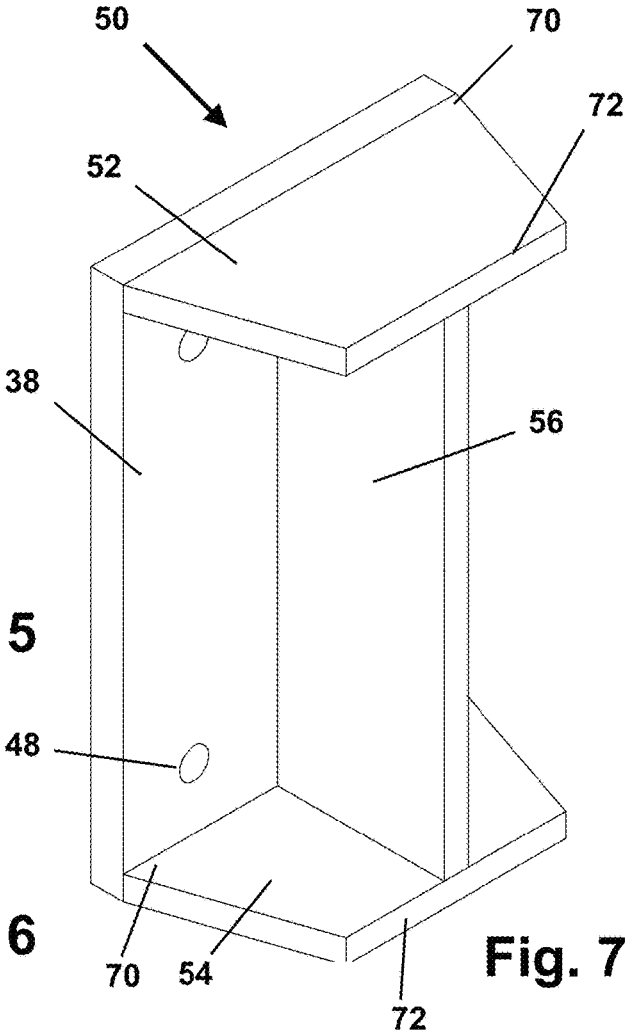
FIG. 7 is a perspective view of a column face plate assembly.

FIGS. 5 through 7 show the construction of the column face plate assembly 50 separate from the column 14. The column face plate assembly 50 is attached to the column 14 and supports the column face plate 38 in a spaced-apart relation to the column surface 42. The column face plate assembly 50, shown by FIG. 7, comprises the column face plate 38, a top gusset 52, a bottom gusset 54, and a vertical plate 56.

From FIG. 5, the column face plate 38 is planar and composed of a robust material, such as steel. The column face plate 38 has a column face plate top end 58 and a column face plate bottom end 60. A column face plate longitudinal axis 62 extends centrally between the column face plate top end 58 and the column face plate bottom end 60. The column face 38 plate defines a column face plate length 66 along the column face plate longitudinal axis 62 and a column face plate width 68 normal to the column face plate longitudinal axis 62. The column face plate length 66 is greater than the column face plate width 68. The column face plate width 68 is greater than the column width 40 (see FIG. 4) at the location to which the column face plate assembly 50 is attached. At least two and preferably four or more holes 48 penetrate the column face plate 38 in a spaced apart relation, with pairs of the holes 48 disposed on opposing sides of the column face plate longitudinal axis 62.

The column face plate longitudinal axis 62 may be parallel to the column longitudinal axis 30, so that the column face plate 38 is vertically-oriented. Alternatively, the column face plate longitudinal axis 62 may intersect the corresponding column longitudinal axis 30 so that the column face plate defines an angle with respect to the column 14 at the location where the column face plate assembly 50 attaches to the column 14, in which event the column face plate 38 is not vertically-oriented and is instead sloped with respect to the column 14.

From FIG. 7, the column face plate 38, top gusset 52, bottom gusset 54, and vertical plate 56 in combination define a column face plate assembly 50. In the column face plate assembly 50, the top gusset 52 is attached to the column face plate top end 58 and the bottom gusset 54 is attached to the column face plate bottom end 60. From FIGS. 6 and 7, each of the top gusset 52 and the bottom gusset 54 has a gusset wide end 70 and a gusset narrow end 72 and is trapezoidal in shape. The gusset wide end width 74 of each of the top gusset 52 and the bottom gusset 54 corresponds to the column face plate width 68. The gusset narrow end width 76 of each of the top gusset 52 and the bottom gusset 54 corresponds to the column width 40 at the location on the column 14 where the column face plate assembly 50 is attached to the column 14. The gusset wide end 70 of the top gusset 52 is attached to the column face plate top end 58. The gusset wide end 70 of the bottom gusset 54 is attached to the column face plate bottom end 60.

From FIG. 7, the vertical plate 56 is disposed on the back side of the column face plate 38 parallel to the column face plate longitudinal axis 62 and attached to the column face plate 38 and to the top gusset 52 and bottom gusset 54. The narrow ends 72 of both the top gusset 52 and the bottom gusset 54 and the vertical plate 56 all are attached to the column surface 42. The column 14, vertical plate 56, top and bottom gussets 52 and 54, and face plate 38 may be composed of steel and the entire column face plate assembly 50 may be joined by welding.

The column face plate transverse axis 64 shown by FIG. 5 and the column longitudinal axis 30 shown by FIG. 3 define mathematical skew lines and a skew angle, as described above and as those terms are used in geometry. The skew angle of the face plate transverse axis 64 and the column longitudinal axis 30 is substantially ninety degrees.

Figure 8:
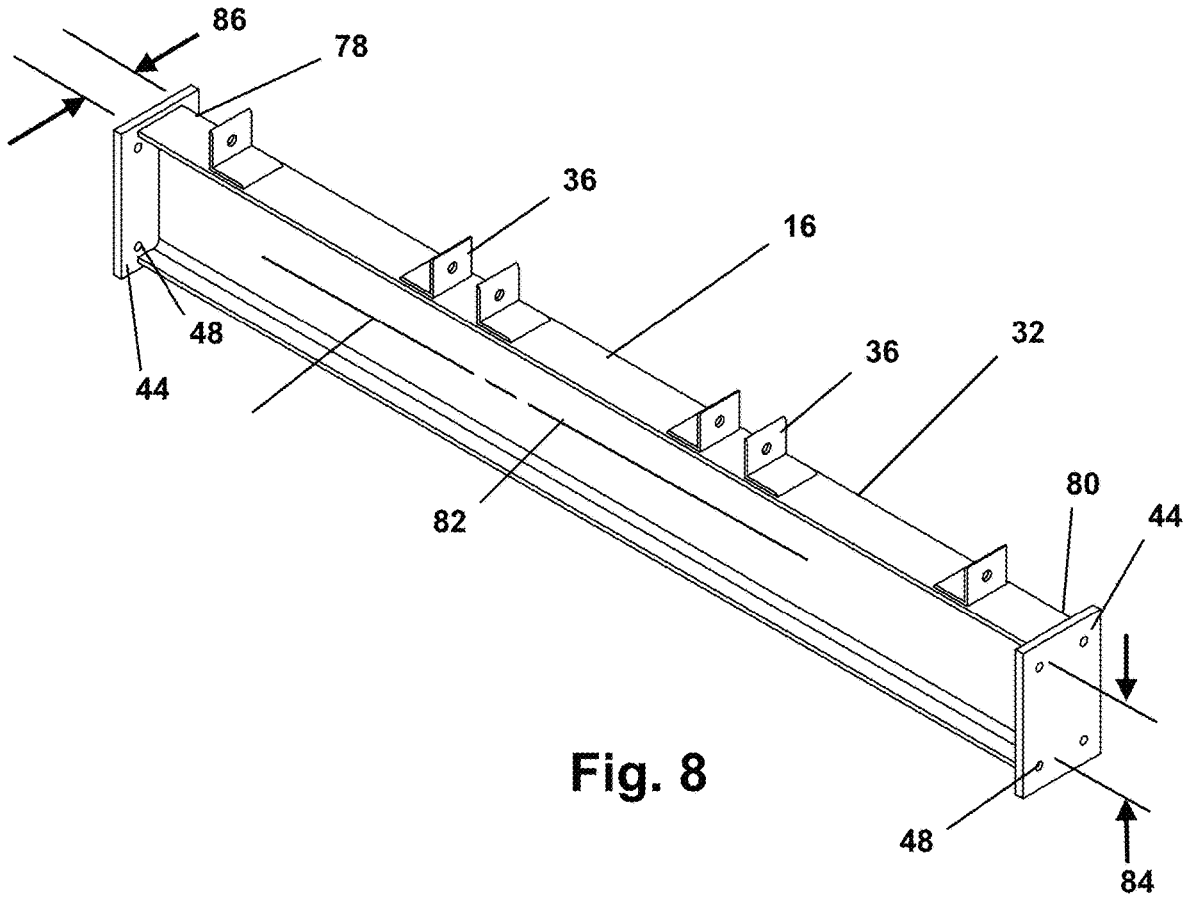
FIG. 8 is an isometric view of a major beam.

FIG. 8 is an isometric view of a major beam 16, in this instance a parallel major beam 32. The major beam 16 is shown in the form of an I-beam, but any other suitable configuration may be used, such as hollow structural sections (HSS). Major beam face plates 44 are attached to the opposing major beam first end 78 and major beam second end 80, as by welding. A major beam longitudinal axis 82 extends between the major beam first end 78 and the major beam second end 80. The major beam 16 has a height 84 and a width 86. The major beam height 84 and width 86 are both less than the major beam face plate width 68 and length 66. The major beam face plates have holes 48 that align with the holes 48 in the column face plates 38. The length 66 and width 68 of the major beam face plates 44 also match the length 66 and width 68 of the column face plates 38. The minor beam support brackets 36 shown on FIG. 8 are specific to a parallel major beam 32, so that the minor beams 18 attached to the minor beam support brackets 32 will be normal to the sidewalk longitudinal axis 6. A transverse major beam 34 is similar to the parallel major beam 32 of FIG. 8, except that the transverse major beam 34 lacks the minor beam support brackets 36.

Figure 9:
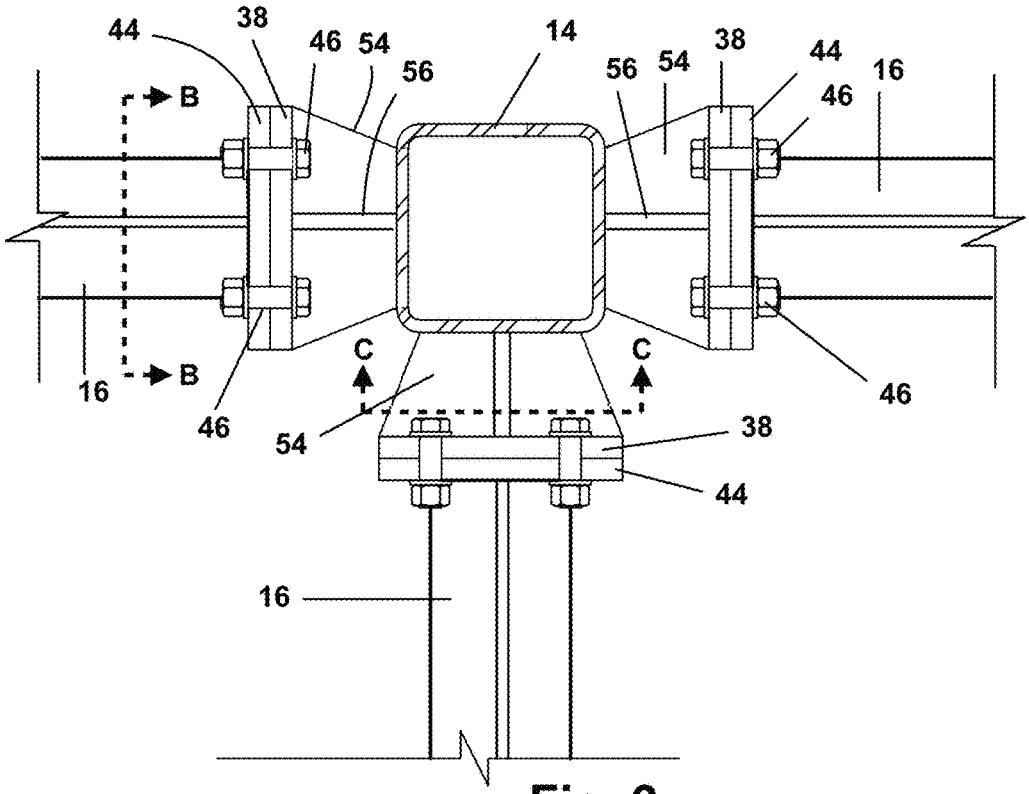
FIG. 9 is a section view through section line A-A of FIG. 11 showing a column with three column face plate assemblies attached to three major beams.
Figure 10:
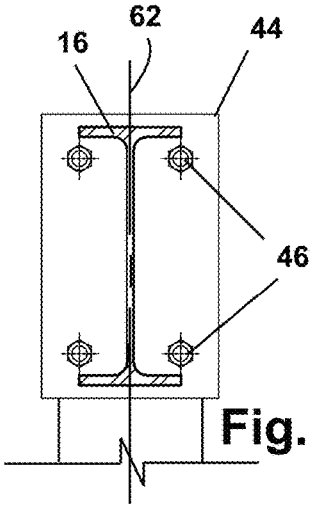
FIG. 10 is a section view through section B-B of FIG. 9 showing the column, major beam face plate and major beam.
Figure 11:
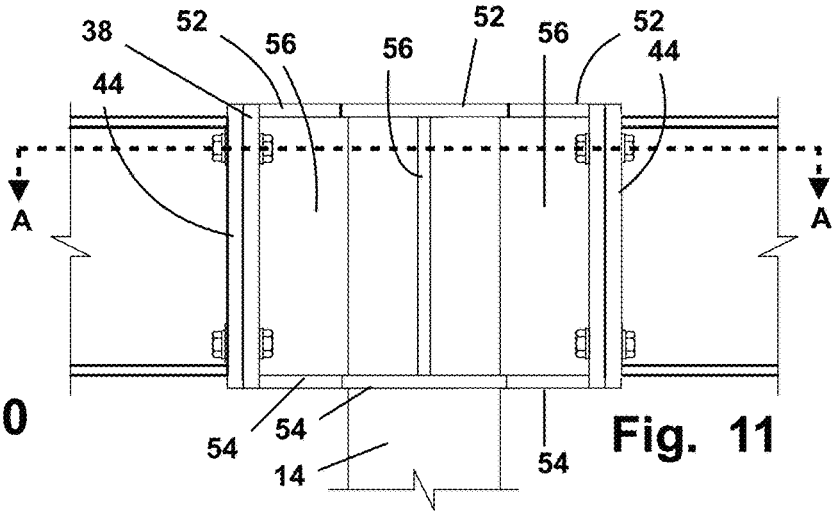
FIG. 11 is a section view through section lint C-C of FIG. 9.

FIGS. 9 through 11 are section views illustrating the attachment of a column 14 to the major beams 16 using column face plates 38 and major beam face plates 44. FIG. 9 is a sectional view through section line A-A of FIG. 11. FIG. 10 is a section view through section lines B-B of FIG. 9. FIG. 11 is a section view through section lines C-C of FIG. 9. Each of FIGS. 9 through 11 show column face plates 38 attached by bolts 46 to corresponding major beam face plates 44. The top gusset 52, bottom gusset 54 and vertical plate 56 provide a robust and distributed attachment of the column face plate 38 to the column surface 42. The use of the column and major beam face plates 38, 44 allows the bolt holes 48 to be spaced laterally further apart than would be possible without the column and major beam face plates 38, 44. The robust connection of the column face plates 38 to the column 14, combined with the relatively large face plates 38, 44 and the spaced-apart bolt 46 connections, provide robust resistance to torsional forces acting on the column-14-to-major-beam-16 connections that otherwise could result in the collapse of the sidewalk shed. As shown by FIG. 9, the spaced-apart relation of the column face plate 38 and the column surface 42, combined with the spaced-apart relation of opposing pairs of holes 48 penetrating the column face plates 38 and major beam face plates 44, also provides access to both sides of the face plates 38, 44 to install nuts and bolts 46. This ease of access and hence of construction and deconstruction is important to the sidewalk shed industry and a benefit of the system of the Invention.

Figure 12:
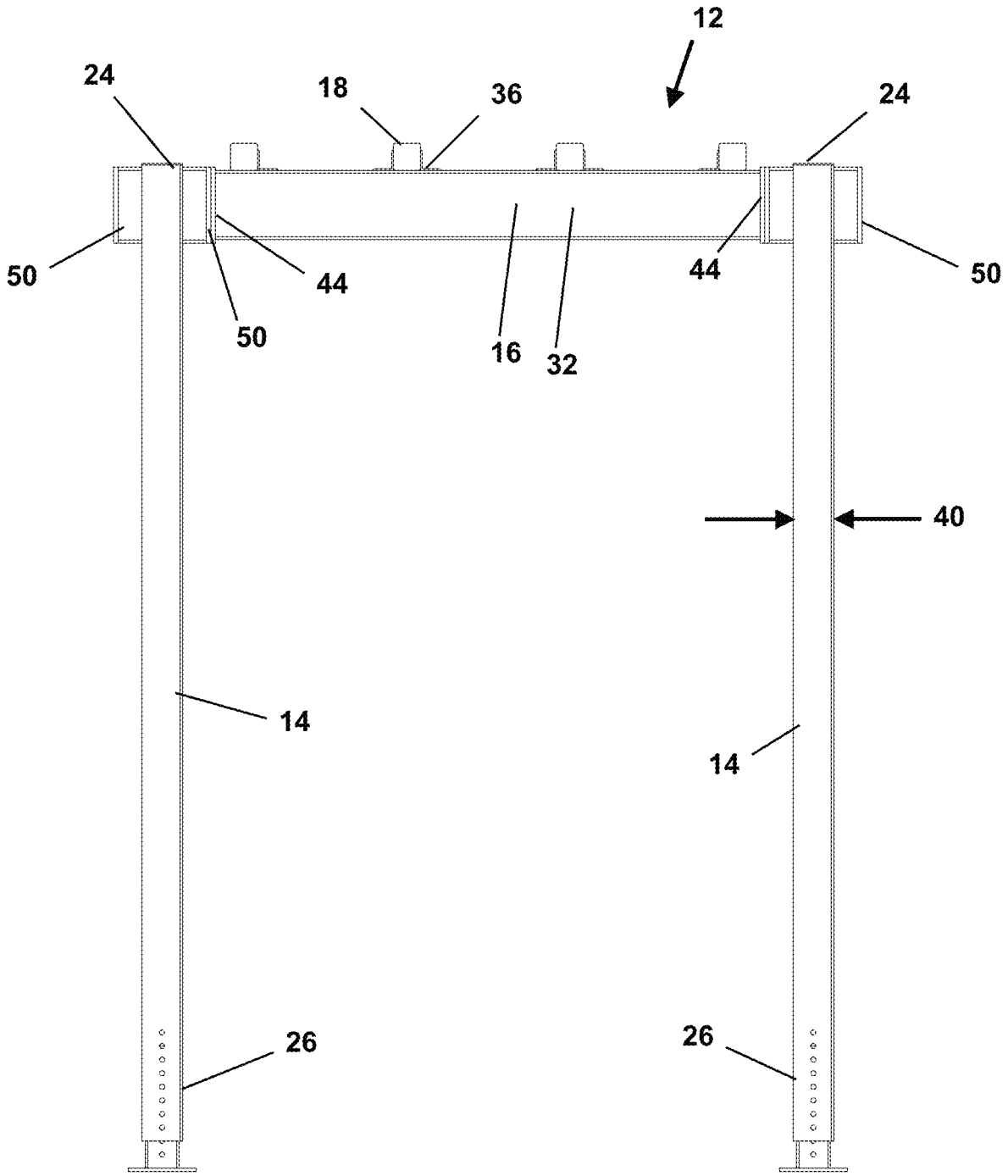
FIG. 12 is a side view of the sidewalk shed of FIG. 2 normal to the sidewalk longitudinal axis.
Figure 13:
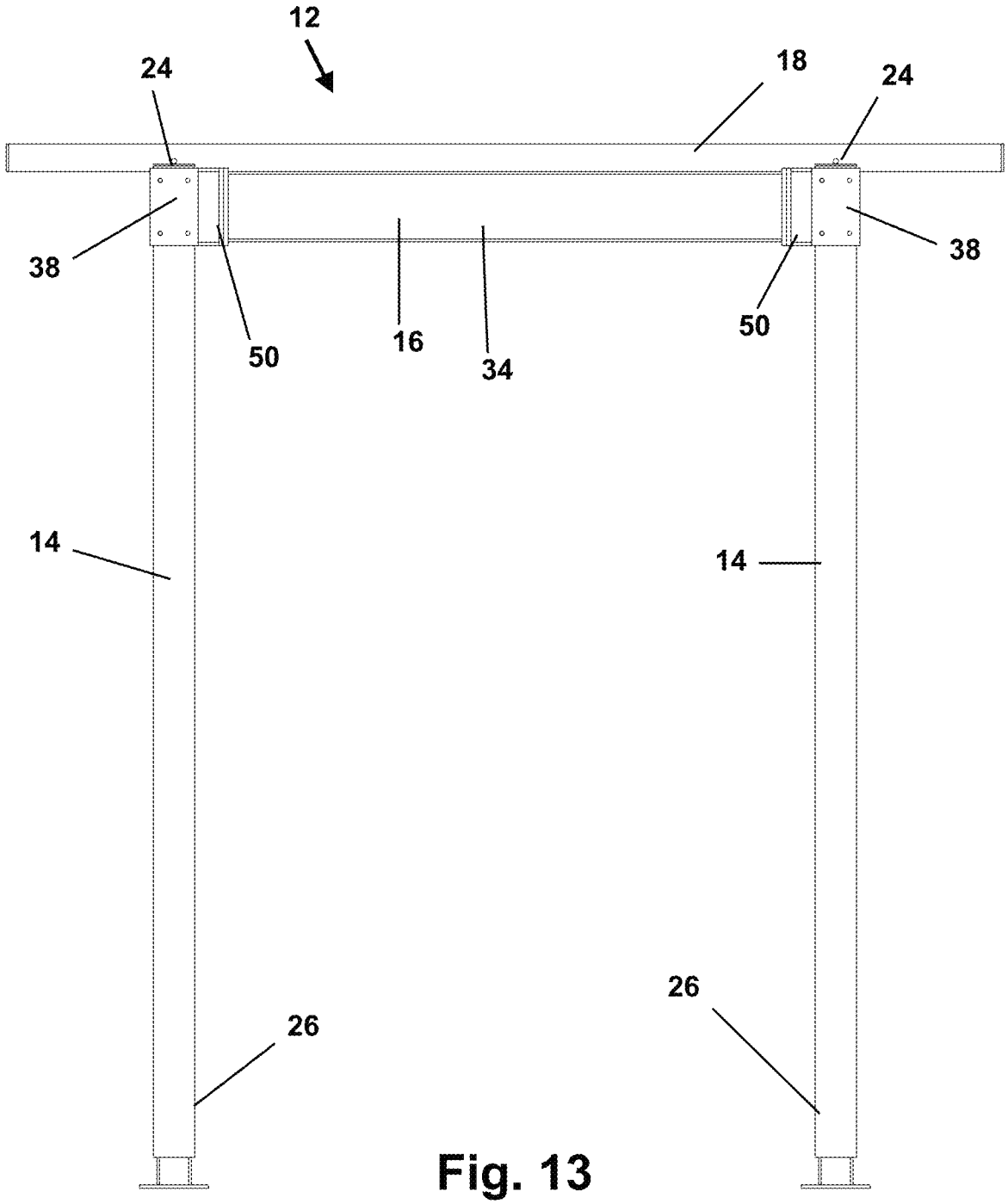
FIG. 13 is a side view of the sidewalk shed of FIGS. 2 and 12 viewed along the sidewalk longitudinal axis.
Figure 14:
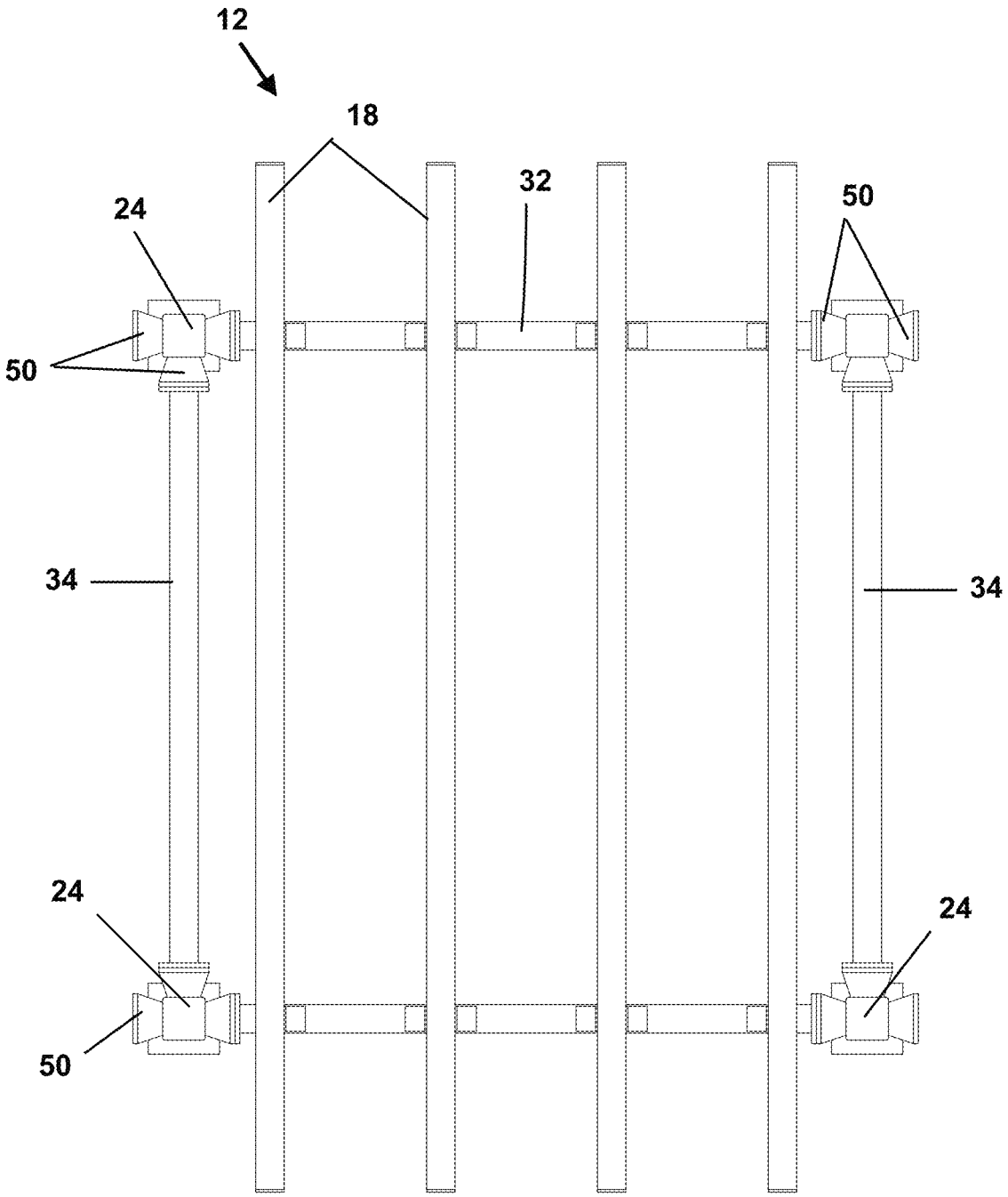
FIG. 14 is top view of the sidewalk shed of FIGS. 2, 12 and 13.

FIGS. 12 through 14 are additional views of the rectangular frame 12 of FIG. 2. FIG. 12 is a side view of the rectangular frame 12 normal to the sidewalk longitudinal axis 6, showing the columns 14, column face plate assemblies 50, a parallel major beam 32 and the ends of minor beams 18. FIG. 13 is an end view of the rectangular frame 12 along the sidewalk longitudinal axis 6 showing two columns 14, a transverse major beam 34, a minor beam 18 supported by the parallel major beams 32. FIG. 14 is a plan view of the rectangular frame 12 showing the column tops 24 of four columns 14, two parallel major beams 32, two transverse major beams 34, the minor beams 18 supported by the parallel major beams 32, and the minor beam brackets 36 to which the minor beams 18 are attached.

Figure 15:
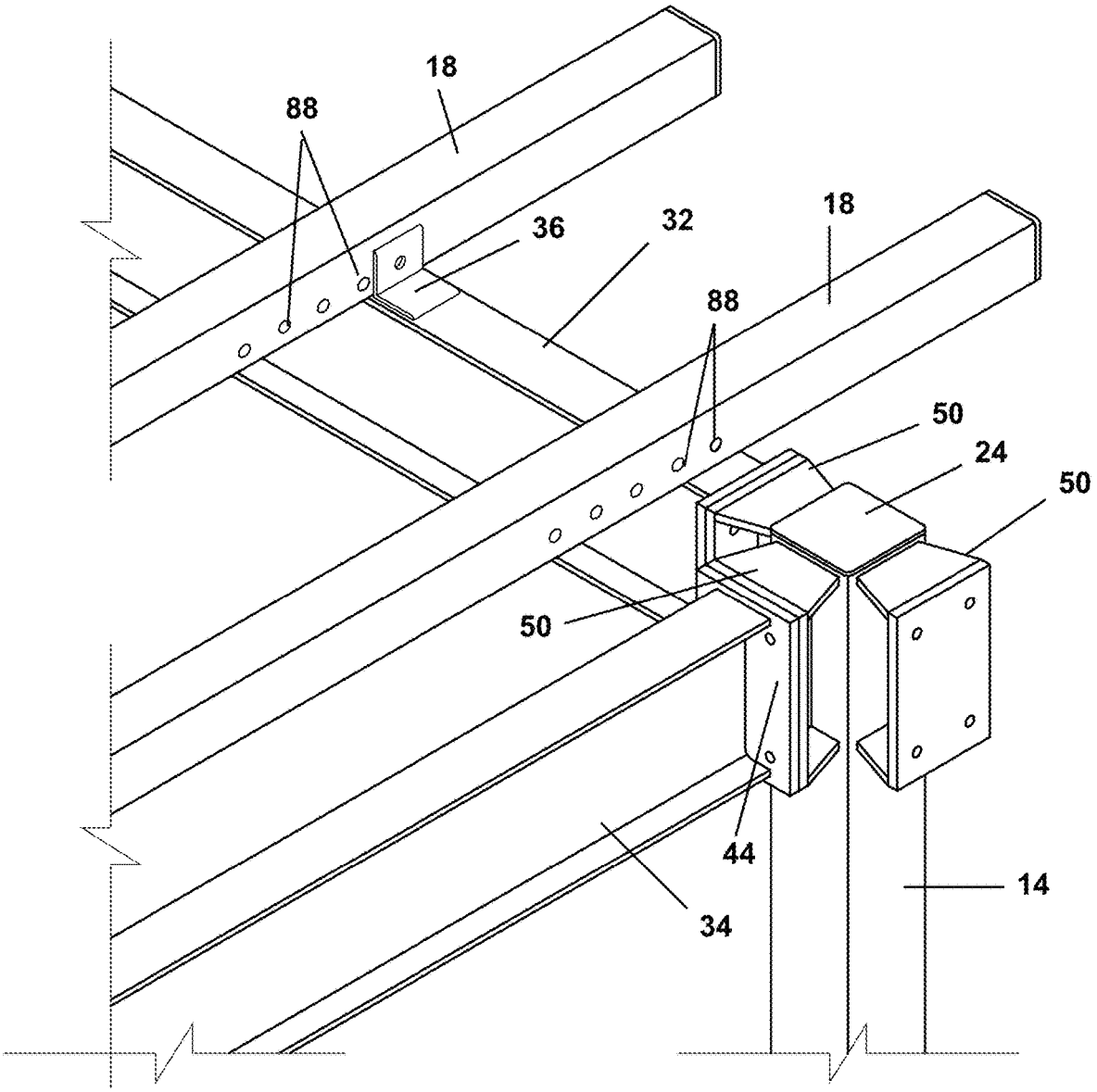
FIG. 15 is an isometric detail view of a column and major beams supporting minor beams.
Figure 16:
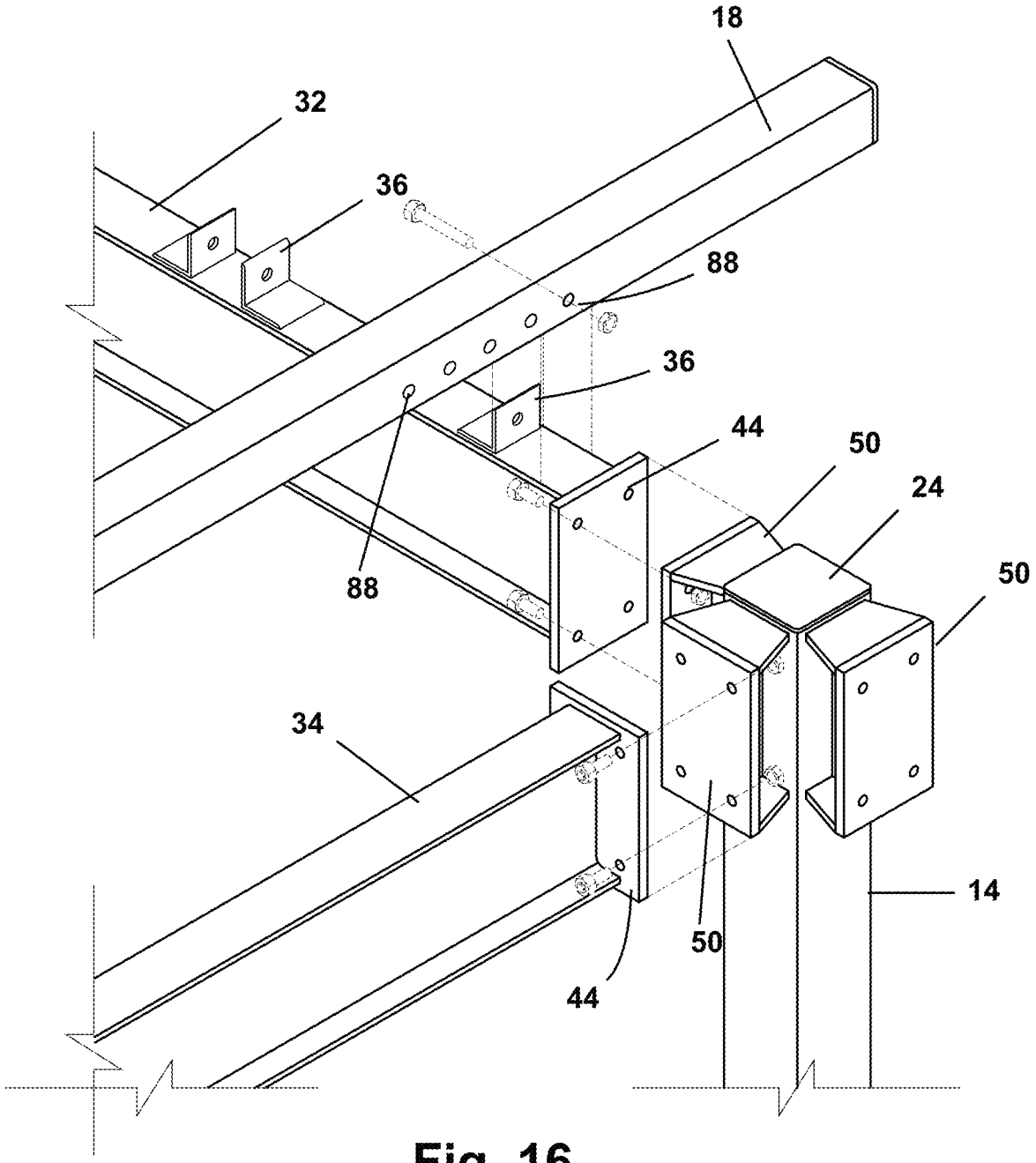
FIG. 16 is an exploded view of FIG. 14.

FIGS. 15 and 16 illustrate attachment of the minor beams 18 to the parallel major beams 32. As shown by FIGS. 15 and 16, the parallel major beams 32 support minor beam brackets 36. The minor beam brackets 36 provide an attachment point for the minor beams 18 and also remind the installer to correctly space the minor beams 18 on the parallel major beams 32.

From FIGS. 15 and 16, the minor beams 18 may be fixed in a plurality of locations normal to the sidewalk longitudinal axis 6. A plurality of engagement features 88, such as clips or engagement holes, may be disposed on the minor beam 18 and configured to engage a minor beam support bracket 36. The plurality of engagement features 88 allows the minor beam 88 to be fixed, as by a bolt, at any of a plurality of locations with respect to the sidewalk longitudinal axis 6. Alternatively, the minor beams 18 may be of different lengths. The length of the minor beam 18 or the positions of adjustable minor beams 18 may be selected to clear a building facade, to provide additional coverage for a sidewalk 4, to avoid road furniture, or to provide consistent parapet 20 anchoring locations.

The minor beams 18 may support decking, as is known in the art. Although not shown, decking may be composed of wooden planks. Alternatively, the decking may comprise a metal lattice to allow light to penetrate the deck to the sidewalk below. Metal lattice decking may be covered by transparent plates, such as plates of acrylic or polycarbonate, to block water and small objects from falling through the metal lattice to the sidewalk below. The sidewalk shed may be wired for electrical power and may including artificial lighting.

As shown by FIGS. 2, 3 and 12, the column bottoms may include adjustable column bases 90, which are useful for adjusting the height of the column 14 to conform to irregularities in the sidewalk 4. From FIG. 2, the column base 90 may telescope into the hollow column bottom 26. Rows of height adjustment holes penetrate the column bottom 26 and one or more corresponding holes penetrate the base 90. An operator will select the height of the column by inserting height-fixing bolts through the height-adjustment holes corresponding to the selected height.

Alternatively, and as shown by FIG. 1, height adjustment for column may comprising a threaded engagement between the column base 90 and the column bottom 26. A threaded rod attached to the column base 90 and aligned with the column longitudinal axis 30 is in threaded engagement with a female thread attached to the column bottom 26. Turning the column base 90 with respect to the column bottom 26 either shortens or lengthens column 14 to conform the column to the sidewalk 4. A column bottom 26 may include both a telescoping column base 90 and a threaded rod so that the height of the column 14 may be coarsely adjusted using the telescoping attachment and finely adjusted using the threaded rod.

Figure 17:
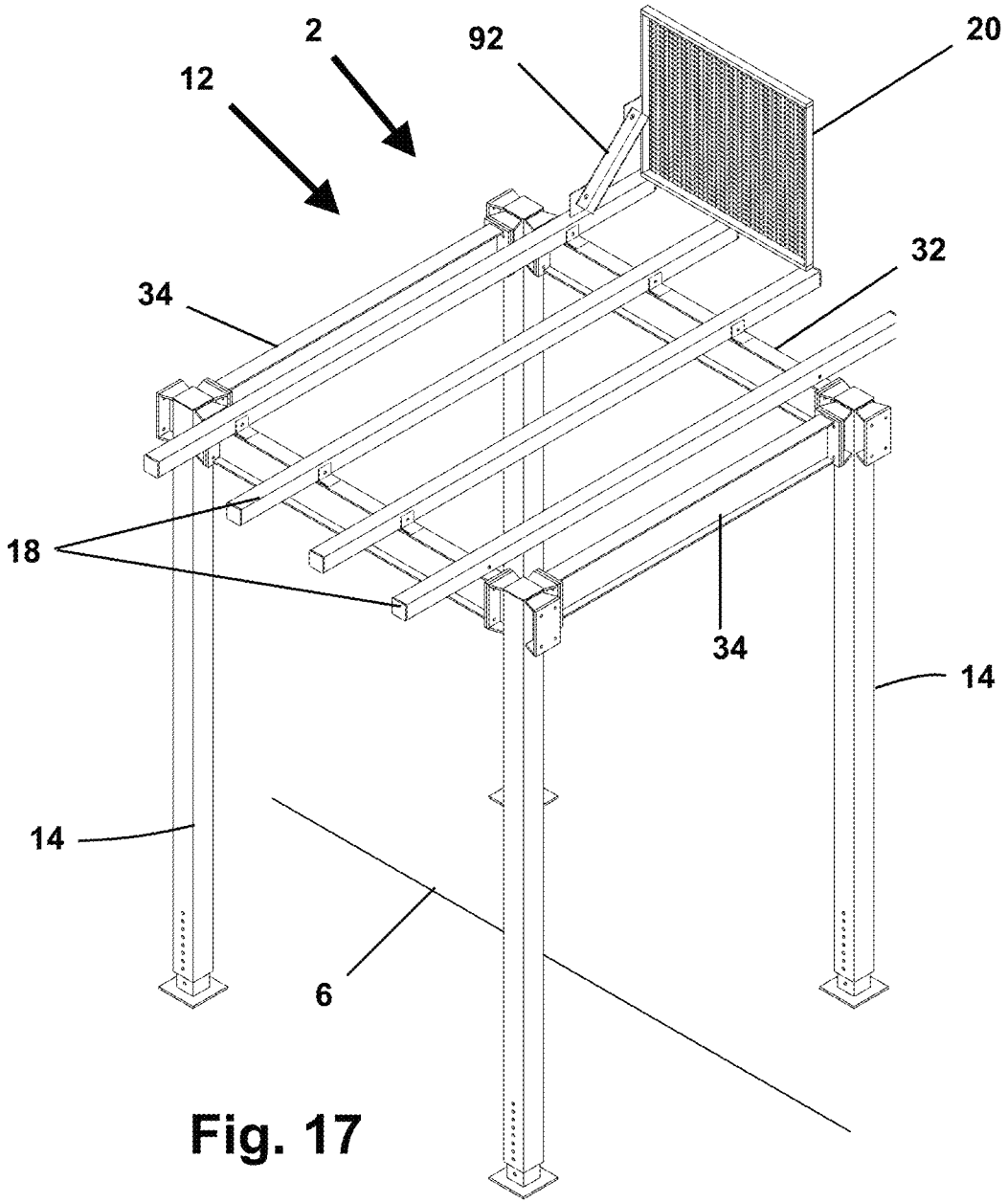
FIG. 17 is an isometric view of the sidewalk shed of FIG. 2 having an attached parapet.
Figure 18:
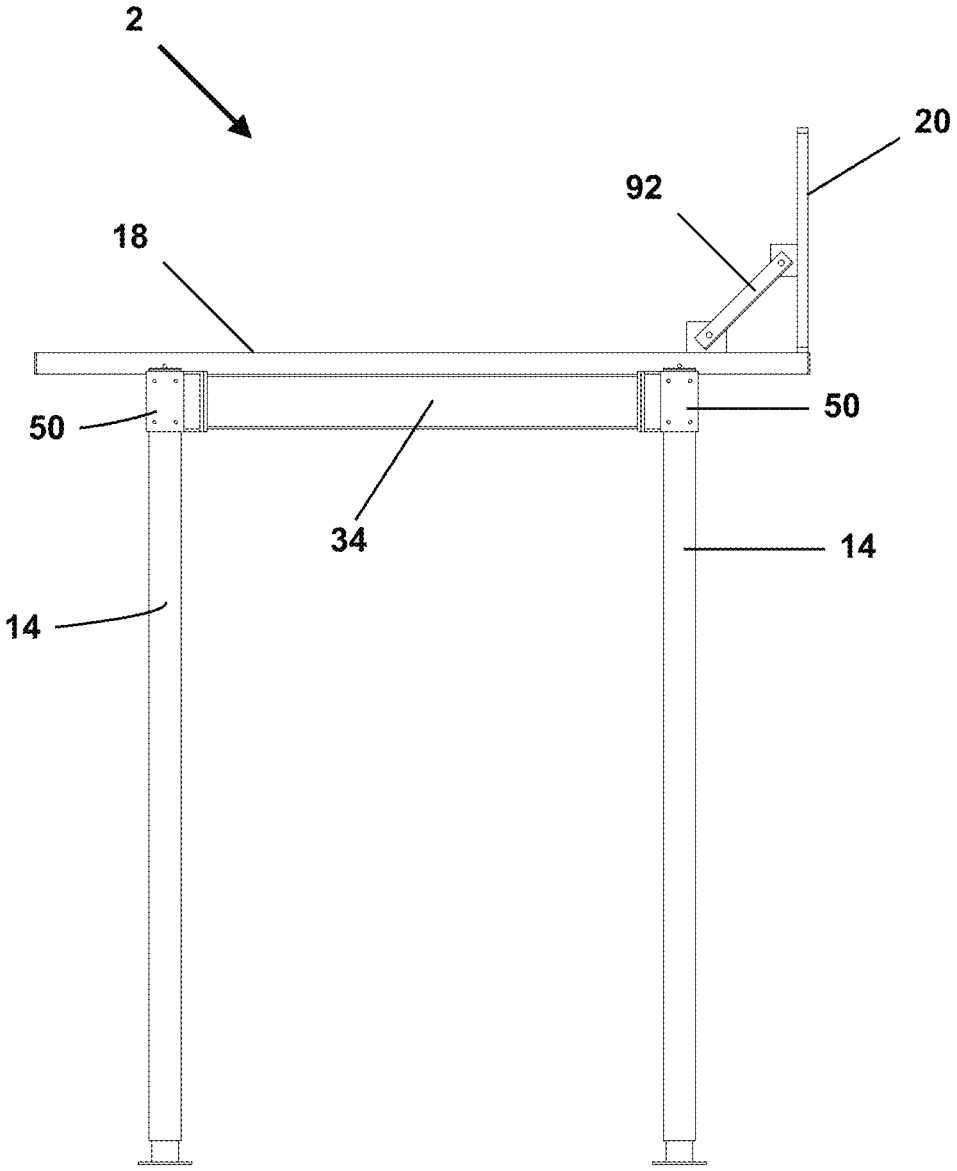
FIG. 18 is a side view of the sidewalk shed of FIG. 2 with an attached parapet.

FIGS. 17 and 18 show a parapet 20. The parapet 20 is a vertical barrier that traps objects on the decking and prevents those objects from falling to the sidewalk 4 or street below. The parapets 20 also hides objects on the decking and provide locations for signage. FIG. 17 is an isometric view of the sidewalk shed system 2 of FIG. 2 with a parapet 20 disposed at the end of the minor beams 18. FIG. 18 is an end view of the sidewalk shed system 2 of FIG. 13 with the parapet 20 attached.

As shown by FIG. 17, a first end of the angle bracket 92 may be attached to the minor beam 18 and a second end of the angle bracket 92 may be attached to the parapet 20. The parapet 20 may include a minor beam 18 engaging member that slidably engages the end of the hollow minor beam 18. Alternatively, the parapet 20 may be bolted to the minor beam 18 so that the parapet 20, angle bracket 92 and minor beam 18 define a triangle.

The sidewalk shed system 2 may define more than one elevation, as where a portion of the sidewalk shed system 2 must be higher to accommodates a large entrance door in the building or to clear a store facade. The sidewalk shed of the Invention can accommodate more than one elevation by providing columns 10 (see FIG. 1) that have column face plates 38 attached to the column sides 42 at more than one location along the longitudinal axis 30 of the column 14. For example, a column 10 may include a first set of face plates 38 attached to the column sides at twenty feet above the ground and may have a second set of column face plates 38 attached at ten feet above the ground. The column face plates 38 then could support major beams 16 at both the ten feet elevation and the twenty feet elevation.

In this document, an element appearing on a drawing has the same meaning when the element appears on another drawing unless the context indicates otherwise.

The following is a list of numbered elements from the specification and drawings.

A sidewalk shed system 2
A sidewalk 4
A sidewalk longitudinal axis 6
A sidewalk corner 8
Different elevations 10
A rectangular frame 12
A column 14
A major beam 16
A minor beam 18
A parapet 20
A stub major beam 22
A column top end 24
A column bottom end 26
A column side 28
A column longitudinal axis 30
A parallel major beam 32
A transverse major beam 34
A minor beam support bracket 36
A column face plate 38
A column width 40
A column surface 42
A major beam face plate 44
A bolt 46
A hole 48
A column face plate assembly 50
A top gusset 52
A bottom gusset 54
A vertical plate 56
A column face plate top end 58
A column face plate bottom end 60
A column face plate longitudinal axis 62
A column face plate transverse axis 64
A column face plate length 66
A column face plate width 68
A gusset wide end 70
A gusset narrow end 72
A gusset wide end width 74
A gusset narrow end width 76
A major beam first end 78
A major beam second end 80
A major beam longitudinal axis 82
A major beam height 84
A major beam width 86
A minor beam engagement feature 88
An adjustable column base 90
An angle bracket 92

What is claimed is:

1. A sidewalk shed, the sidewalk shed comprising:

a) a column, the column having a column base and a column top, the column defining a column longitudinal axis between the column base and the column top, the column having a column outer surface, the column outer surface defining a column width normal to the column longitudinal axis;

b) a column face plate, the column face plate being supported by the column proximal to the column top, the column face plate being planar and defining a column face plate top end and an opposing column face plate bottom end, the column face plate having a column face plate longitudinal axis between the column face plate top end and the column face plate bottom end, the column face plate having a column face plate transverse axis, the column face plate transverse axis and the column longitudinal axis defining skew lines, the angle between the skew lines being substantially a right angle, the column face plate having a width along the column face plate transverse axis, the column face plate width being greater than the column width;

c) a major beam, the major beam being elongated and having a major beam first end and an opposing major beam second end, the major beam defining a major beam longitudinal axis between the major beam first end and the major beam second end, the major beam having a major beam height and a major beam width;

d) a first major beam face plate and a second major beam face plate, the first major beam face plate being attached to the major beam at the major beam first end, the second major beam face plate being attached to the major beam at the major beam second end, the first major beam face plate and the second major beam face plate each being planar, the first major beam face plate and the second major beam face plate each having a major beam face plate length and a major beam face plate width, the major beam face plate length corresponding to the column face plate length and being greater than the major beam height, the major beam face plate width corresponding to the column face plate width and being greater than the major beam width, the major beam longitudinal axis being substantially normal to the column longitudinal axis when the first major beam face plate or the second major beam face plate is releasably attached to the column face plate;

e) a top gusset, the top gusset being planar and trapezoidal in shape, the top gusset having a top gusset narrow end with a top gusset narrow end width, the top gusset narrow end width corresponding to the column width, the top gusset narrow end being attached to the column surface, the top gusset having a top gusset wide end having a top gusset wide end width, the top gusset wide end width corresponding to the column face plate width, the top gusset wide end being attached to the column face plate top end, the top gusset wide end width being greater than the top gusset narrow end width;

f) a bottom gusset, the bottom gusset being planar and trapezoidal in shape, the bottom gusset having a bottom gusset narrow end having a bottom gusset narrow end width, the bottom gusset narrow end width corresponding to the column width, the bottom gusset narrow end being attached to the column surface, the bottom gusset having a bottom gusset wide end having a bottom gusset wide end width, the bottom gusset wide end width corresponding to the column face plate width, the bottom gusset wide end being attached to the column face plate bottom end, the bottom gusset wide end width being greater than the bottom gusset narrow end width, the top gusset and the bottom gusset thereby attaching the column face plate to the column in a spaced-apart relation to the column surface;

g) a plurality of major beam face plate holes defined by the first major beam face plate or by the second major beam face plate and a plurality of column face plate holes defined by the column face plate, each of the the major beam face plate holes corresponding to a one of the column face plate holes;

h) a plurality of threaded bolts and threaded nuts configured for threaded engagement, the column face plate being in a spaced apart relation to the column outer surface to receive a one of the threaded bolt and the threaded nut between the column outer surface and the column face plate, each of the threaded bolts being configured to penetrate a one of the major beam face plate holes and the corresponding column face plate hole, each of the threaded nuts being configured for threaded engagement with the threaded bolt when the threaded bolt is penetrating the major beam face plate hole and the column face plate hole so that a one of the threaded bolt and the threaded nut engages the column face plate and the other of the threaded bolt and the threaded nut engages the major beam face plate thereby releasably attaching the major beam to the column, wherein the first major beam face plate and the second major beam faceplate are interchangeably attachable to the column face plate.

2. The sidewalk shed of claim 1 wherein the column face plate longitudinal axis being substantially parallel to the column longitudinal axis and wherein the first major beam face plate and the second major beam face plate are substantially normal to the major beam longitudinal axis.

3. The sidewalk shed of claim 1, further comprising: a vertical plate having a first vertical plate edge and an opposing second vertical plate edge, the first vertical plate edge being aligned with the column longitudinal axis and attached to the column surface, the second vertical plate edge being aligned with the column face plate longitudinal axis and attached to the column face plate, the vertical plate being disposed between and attached to the top gusset and the bottom gusset, wherein the vertical plate, the top gusset and the bottom gusset in combination support the column face plate in a spaced-apart relation to the column surface, and wherein the vertical plate, the top gusset, the bottom gusset, and the column face plate in combination define a column face plate assembly.

4. The sidewalk shed of claim 3 wherein the column is a one of at least four columns and the major beam is a one of at least four major beams, and wherein each of the at least four columns includes at least two face plate assemblies attached to each column proximal to the column top end, wherein each of the at least four columns is releasably attachable to two of the major beams and wherein each of the at least four major beams is releasably attachable to two of the columns.

5. The sidewalk shed of claim 4 wherein when four of the major beams releasably connect four columns with each of the four major beams connected to two of the four columns, the four columns and the four major beams that are connected in combination define a rectangular frame, the rectangular frame having a longitudinal direction corresponding to a sidewalk direction and a transverse direction normal to the sidewalk direction, and wherein two of the four major beams are parallel major beams that extend parallel to the sidewalk direction, and two of the major beams are transverse major beams that extend in the transverse direction.

6. The sidewalk shed of claim 5, further comprising:

a plurality of minor beams, each of the minor beams extending transverse to the sidewalk direction and spanning the parallel major beams;

a plurality of minor beam support brackets attached to a parallel major beam top side, each of the plurality of minor beam support brackets corresponding to a one of the plurality of minor beams, each of the plurality of minor beams being releasably attachable to the parallel major beams at the corresponding minor beam support bracket.

7. The sidewalk shed of claim 6, further comprising: a parapet and a parapet support bracket, the parapet and the parapet support bracket being releasably attachable to the minor beams.

8. The sidewalk shed of claim 7, further comprising: a decking, the decking the decking being supported by the plurality of minor beams when the decking is placed upon the minor beams.

9. The sidewalk shed of claim 4 wherein the sidewalk shed defines four corners and wherein a one of the at least four columns is disposed at each of the four corners, each of the four columns disposed at the four corners having at least two column face plate assemblies attached to the column, wherein two of the at least two column face plate assemblies attached to each column at each corner are mutually oriented at a right angle.

10. The sidewalk shed of claim 9, wherein the at least four columns comprise at least six columns and the at least four major beams comprise at least seven major beams, wherein when the first major beam face plate and the second major beam face plate of each of the major beams are releasably attached to two of the columns, with each of the seven major beams releasably attached to two of the six columns, the seven major beams and the six columns in combination define two conjoined rectangular frames with each of the two conjoined rectangular frames sharing a one of the seven major beams, and wherein two of the six columns are disposed intermediate to two of the four corners, the two columns that are disposed intermediate to two of the four corners each including at least three column face plate assemblies.

11. The sidewalk shed of claim 10 wherein the sidewalk shed is configured to turn a sidewalk corner, the sidewalk shed further comprising:

the at least six columns comprising eight columns, the at least seven major beams comprising ten major beams, and the four corners comprising five corners;

wherein a one of the eight columns is an inside corner column corresponding to the sidewalk corner, the inside corner column having four face plate assemblies attached and radially arrayed about the longitudinal axis of the inside corner column so that the inside corner column is releasably attachable to four other of the columns by four major beams;

wherein when the first major beam face plate and the second major beam face plate of each of the ten major beams are releasably attachable to two of the corresponding column face plates of the eight columns with four of the ten major beams attached to the corner column, the eight columns and ten major beams in combination define three of the conjoined rectangular frames with the inside corner column disposed at the sidewalk corner and the three conjoined rectangular sidewalk shed frames disposed about the sidewalk corner when the sidewalk frame is located at the sidewalk corner.

12. The sidewalk shed of claim 4 wherein the sidewalk shed does not include a cross brace between any of the columns, between any of the major beams, and between any of the columns and any of the major beams.

13. The sidewalk shed of claim 4 wherein at least two of the columns include one or more face plate assemblies attached at different locations along the longitudinal axis of the columns, whereby at least one of the major beams may be attached to the at least two columns at a different height than another of the major beams.

14. A sidewalk shed, the sidewalk shed comprising:

a) a column, the column having a column base and a column top, the column defining a column longitudinal axis between the column base and the column top, the column having a column outer surface, the column outer surface defining a column width normal to the column longitudinal axis;

b) a column face plate, the column face plate being supported by the column in a spaced apart relation to the column outer surface proximal to the column top, the column face plate being planar and defining a column face plate top end and an opposing column face plate bottom end, the column face plate having a column face plate longitudinal axis between the column face plate top end and the column face plate bottom end, the column face plate having a column face plate transverse axis, the column face plate transverse axis and the column longitudinal axis defining skew lines, the angle between the skew lines being substantially a right angle, the column face plate having a width along the column face plate transverse axis, the column face plate width being greater than the column width;

c) a major beam, the major beam being elongated and having a major beam first end and an opposing major beam second end, the major beam defining a major beam longitudinal axis between the major beam first end and the major beam second end, the major beam having a major beam height and a major beam width;

d) a first major beam face plate and a second major beam face plate, the first major beam face plate being attached to the major beam at the major beam first end, the second major beam face plate being attached to the major beam at the major beam second end, the first major beam face plate and the second major beam face plate each being planar, the first major beam face plate and the second major beam face plate each having a major beam face plate length and a major beam face plate width, the major beam face plate length corresponding to the column face plate length and being greater than the major beam height, the major beam face plate width corresponding to the column face plate width and being greater than the major beam width, the first major beam face plate and the second major beam face plate each having a configuration for interchangeable and releasable attachment to the column face plate, the major beam longitudinal axis being substantially normal to the column longitudinal axis when the first major beam face plate or the second major beam face plate is releasably attached to the column face plate;

e) a column foot, the column foot being adjustably attached to the column at the column base and having a configuration to adjust a height of the column, the configuration of the column foot to adjust the height of the column comprising a plurality of holes defines by the column base and a corresponding plurality of holes defined by the column foot, a foot fastener being configured to penetrate a one of the column holes and a one of the foot holes to select the height of the column, alternatively the configuration of the column foot to adjust the height of the column comprising a threaded engagement between the column foot and the column so that relative rotation of the column foot and the column selects the height of the column.

15. A sidewalk shed, the sidewalk shed comprising:

a) a column, the column having a column base and a column top, the column defining a column longitudinal axis between the column base and the column top, the column having a column outer surface, the column outer surface defining a column width normal to the column longitudinal axis;

b) a column face plate, the column face plate being supported by the column proximal to the column top, the column face plate being planar and defining a column face plate top end and an opposing column face plate bottom end, the column face plate having a column face plate longitudinal axis between the column face plate top end and the column face plate bottom end, the column face plate longitudinal axis being substantially parallel to the column longitudinal axis, the column face plate having a column face plate transverse axis, the column face plate transverse axis and the column longitudinal axis defining skew lines, the skew angle between the skew lines being substantially a right angle, the column face plate having a width along the column face plate transverse axis, the column face plate width being greater than the column width;

c) a major beam, the major beam being elongated and having a major beam first end and an opposing major beam second end, the major beam defining a major beam longitudinal axis between the major beam first end and the major beam second end, the major beam having a major beam height and a major beam width;

d) a first major beam face plate and a second major beam face plate, the first major beam face plate being attached to the major beam at the major beam first end, the second major beam face plate being attached to the major beam at the major beam second end, the first major beam face plate and the second major beam face plate each being planar, the first major beam face plate and the second major beam face plate are substantially normal to the major beam longitudinal axis, the first major beam face plate and the second major beam face plate each having a major beam face plate length and a major beam face plate width, the major beam face plate length corresponding to the column face plate length and being greater than the major beam height, the major beam face plate width corresponding to the column face plate width and being greater than the major beam width, the major beam longitudinal axis being substantially normal to the column longitudinal axis when the first major beam face plate or the second major beam face plate is releasably attached to the column face plate;

e) a top gusset, the top gusset being planar and trapezoidal in shape, the top gusset having a top gusset narrow end with a top gusset narrow end width, the top gusset narrow end width corresponding to the column width, the top gusset narrow end being attached to the column surface, the top gusset having a top gusset wide end having a top gusset wide end width, the top gusset wide end width corresponding to the column face plate width, the top gusset wide end being attached to the column face plate top end, the top gusset wide end width being greater than the top gusset narrow end width;

f) a bottom gusset, the bottom gusset being planar and trapezoidal in shape, the bottom gusset having a bottom gusset narrow end having a bottom gusset narrow end width, the bottom gusset narrow end width corresponding to the column width, the bottom gusset narrow end being attached to the column surface, the bottom gusset having a bottom gusset wide end having a bottom gusset wide end width, the bottom gusset wide end width corresponding to the column face plate width, the bottom gusset wide end being attached to the column face plate bottom end, the bottom gusset wide end width being greater than the bottom gusset narrow end width;

g) a plurality of column face plate holes defined by the column face plate and a corresponding plurality of major beam face plate holes defined by the first major beam face plate or by the second major beam face plate, the plurality of column face plate holes being laterally spaced apart by an amount greater than would be possible if the column face plate holes were defined by the column rather than by the column face plate;

h) a plurality of threaded bolts and threaded nuts configured for threaded engagement, the column face plate being in a spaced apart relation to the column outer surface to receive a one of the threaded bolt and the threaded nut between the column outer surface and the column face plate, each of the threaded bolts being configured to penetrate a one of the major beam face plate holes and the corresponding column face plate hole, each of the threaded nuts being configured for threaded engagement with the threaded bolt when the threaded bolt is penetrating the major beam face plate hole and the column face plate hole so that a one of the threaded bolt and the threaded nut engages the column face plate and the other of the threaded bolt and the threaded nut engages the major beam face plate thereby releasably attaching the major beam to the column, wherein the first major beam face plate and the second major beam faceplate are interchangeably attachable to the column face plate.

16. The sidewalk shed of claim 15, further comprising:

a vertical plate having a first vertical plate edge and an opposing second vertical plate edge, the first vertical plate edge being aligned with the column longitudinal axis and attached to the column surface, the second vertical plate edge being aligned with the column face plate longitudinal axis and attached to the column face plate, the vertical plate being disposed between and attached to the top gusset and the bottom gusset, wherein the vertical plate, the top gusset and the bottom gusset in combination support the column face plate in a spaced-apart relation to the column surface, and wherein the vertical plate, the top gusset, the bottom gusset, and the column face plate in combination define a column face plate assembly.

17. The sidewalk shed of claim 16 wherein the column is a one of four columns and the major beam is a one of four major beams, and wherein each of the four columns includes at least two face plate assemblies attached to each column proximal to the column top end, wherein the first major beam face plate and the second major beam face plate of each of the at least four major beams is releasably attachable to any one of the at least two face plate assemblies of any one on of the four two-face plate columns, wherein each of the four columns is releasably attachable to two of the major beams and wherein each of the four major beams is releasably attachable to two of the columns, the four columns and the four major beams that are connected in combination define a rectangular frame, the rectangular frame having a longitudinal direction corresponding to a sidewalk direction and a transverse direction normal to the sidewalk direction, and wherein two of the four major beams are parallel major beams that extend parallel to the sidewalk direction, and two of the major beams are transverse major beams that extend in the transverse direction.

18. The sidewalk shed of claim 17, further comprising:

a plurality of minor beams, each of the minor beams extending transverse to the sidewalk direction and spanning the parallel major beams;

a plurality of minor beam support brackets attached to a parallel major beam top side, each of the plurality of minor beam support brackets corresponding to a one of the plurality of minor beams, each of the plurality of minor beams being releasably attachable to the parallel major beams at the corresponding minor beam support bracket.

* * * * *